US005513620A

United States Patent [19]

Pyko et al.

[11] Patent Number: 5,513,620

[45] Date of Patent: May 7, 1996

[54] IGNITION ENERGY AND BREAKDOWN VOLTAGE CIRCUIT AND METHOD

[75] Inventors: Jan S. Pyko, Bloomfield Twp.; Anson Lee, St. Clair, both of Mich.

[73] Assignee: Chrysler Corporation, Highland Park, Mich.

[21] Appl. No.: 378,434

[22] Filed: Jan. 26, 1995

[51] Int. Cl.[6] ..... F02P 3/05

[52] U.S. Cl. ..... 123/609; 123/644; 324/380; 324/399

[58] Field of Search ..... 123/609, 620, 123/644; 324/378, 380, 386, 399

[56] References Cited

U.S. PATENT DOCUMENTS

| | | | |
|---|---|---|---|
| 4,006,403 | 2/1977 | Olsen et al. | 324/384 |
| 4,032,842 | 6/1977 | Green et al. | 324/400 |
| 4,166,175 | 9/1978 | Sand | 123/425 |
| 4,441,479 | 4/1984 | Endo et al. | 123/609 |
| 4,479,479 | 10/1984 | Domland et al. | 123/609 |
| 4,661,778 | 4/1987 | Anderson | 324/380 |
| 4,739,743 | 4/1988 | Iwata | 123/609 |
| 4,760,341 | 7/1988 | Skerritt | 324/379 |
| 4,763,630 | 8/1988 | Nagase et al. | 123/501 |
| 4,773,380 | 9/1988 | Narita et al. | 123/609 |
| 4,825,167 | 4/1989 | Bayba | 324/399 |
| 4,846,129 | 7/1989 | Noble | 123/425 |
| 4,899,579 | 2/1990 | Sweppy et al. | 734/118 |
| 4,915,086 | 4/1990 | Ciliberto et al. | 123/609 |
| 5,155,437 | 10/1992 | Frus | 324/399 |
| 5,194,813 | 3/1993 | Hannah et al. | 324/379 |
| 5,208,540 | 5/1993 | Hoeflich | 324/388 |
| 5,269,282 | 12/1993 | Miyata et al. | 123/627 |
| 5,334,938 | 8/1994 | Kugler et al. | 324/399 |

*Primary Examiner*—Willis R. Wolfe
*Attorney, Agent, or Firm*—G. Andrew Barger

[57] ABSTRACT

In an engine and associated ignition energy and breakdown voltage circuit, the engine having at least one spark plug and an associated ignition coil having a primary and secondary winding, the secondary winding in communication with at least one spark plug. The ignition energy and breakdown voltage circuit comprising the ability to sense an arcing current generated by the spark plug, and also includes the ability for probing a spark plug breakdown voltage. A multiplier is provided for multiplying the spark plug arcing current by the arcing voltage and thereby producing a power signal. The ability to store the breakdown voltage of the spark plug for a period of time is provided, and further the ability to produce an energy signal in proportional representation of an amount of energy delivered to the spark plug. A method is also provided for adaptively changing spark plug energy in response to feedback from the ignition energy circuit.

9 Claims, 4 Drawing Sheets

IGNITION ENERGY AND BREAKDOWN VOLTAGE CIRCUIT AND METHOD

BACKGROUND OF THE INVENTION

1. Field of the Invention

The present invention relates generally to the art of spark ignitions. In particular, the present invention relates to a circuit for generating and monitoring an energy signal proportional to the amount of energy delivered to the at least one spark plug. The present invention further generates and monitors a breakdown voltage signal of at least one spark plug.

2. Description of the Related Art

Two major challenges facing automobile manufactures today are fuel economy improvement and reduced emissions. One engine subsystem that could be refined to aid in meeting both of these challenges is the ignition system. Under current engine design techniques, electronic ignition systems are controlled by a microprocessor based controller or Electronic Control Unit (ECU). The controller reads a plurality of sensor inputs such as the crankshaft sensor, camshaft sensor, manifold absolute pressure sensor, throttle position sensor, coolant sensor, etc. and can thereby calculate the appropriate time to fire a spark in each cylinder.

The design of future ignition systems requires the implementation of an optimized solution for ignition requirements versus componentry size, weight, and costs. To accomplish such a task requires a better understanding of the ignition phenomenon and the associated critical parameters. Two of the most critical ignition parameters are the breakdown voltage and the energy levels required for combustion under various engine conditions. Previously, in the art of ignition systems, an ignition circuit has not existed whereby a spark plug energy signal is generated that is scaled in proportion to spark plug energy. In addition a circuit is also needed for capturing the spark plug breakdown voltage while being able to reset the circuit given a separate ignition event. Moreover, it is also highly desirable to have a circuit that monitors the spark plug energy and adaptively changes the amount of spark plug energy.

SUMMARY OF THE INVENTION

In light of such desirable characteristics, not fully present in the related art, the present invention provides, in an engine having at least one spark plug and an associated ignition coil having a primary and secondary winding, the secondary winding in communication with the at least one spark plug, an ignition energy and breakdown voltage circuit. The circuit comprises the ability to sense an arcing current generated by the spark plug. A multiplier is provided for multiplying the spark plug arcing current (I(t)) by a spark plug arcing voltage (V(t)) and thereby producing a power signal (P(t)) according to the equation $P(t)=V(t)*I(t)$ at a given time (t). An ability to store or capture the breakdown voltage of the spark plug for a period of time is provided, and further the ability to produce an energy signal proportional to an amount of energy delivered to the spark plug.

The present invention provides an ignition circuit that is capable of generating a energy signal which is proportional to the energy dissipation of at least one spark plug. In addition, a power signal, equalling the multiplication of the spark plug arcing voltage and arcing current is also generated.

Another advantage is that the energy signal, generated by the present invention, can be used as a feedback signal for controlling the energy level of each cylinder in real time for emission control purposes.

A further advantage of the present invention is that an ignition circuit is provided that also generates and captures the breakdown voltage of at least one spark plug. The circuit also monitors spark plug energy and breakdown voltage. A method is also provided so that spark plug energy is adaptively changed given various condition readings by the ECU.

Other objects, features and advantages of the present invention will become apparent by reference to the following detailed description when considered in conjunction with the accompanying drawings.

BRIEF DESCRIPTION OF THE DRAWINGS

In the drawings below, reference characters refer to like parts throughout the views, and wherein.

DESCRIPTION OF THE PREFERRED EMBODIMENT(S)

Figure 1:
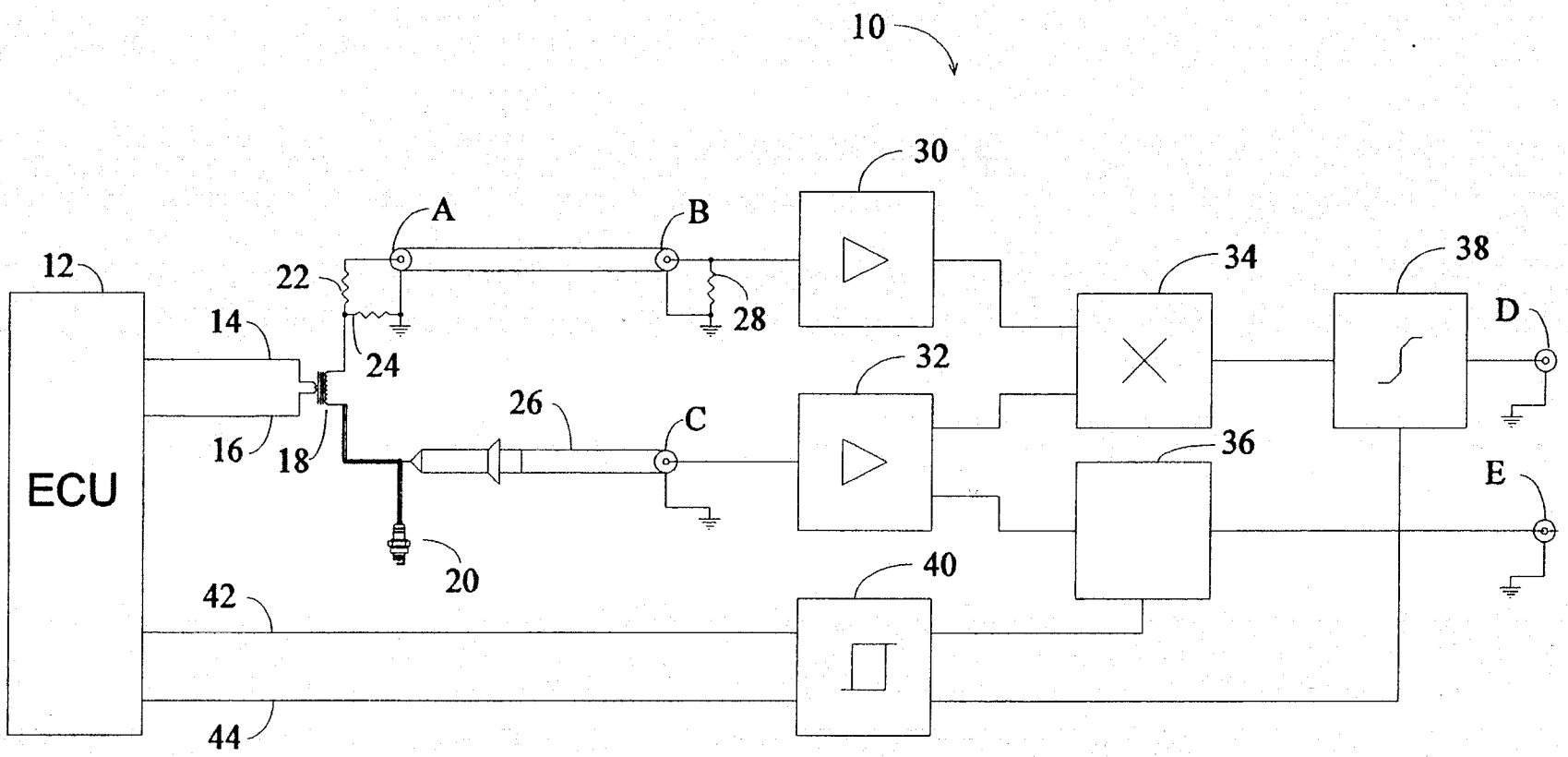
FIG. 1 is a block schematic diagram of the ignition energy and breakdown voltage circuit of the present invention.

Commencing with FIG. 1, an ignition energy and breakdown voltage circuit 10 is shown. The circuit 10 comprises an engine controller or Electronic Control Unit (ECU) 12. The ECU 12 includes a microprocessor, memory (volatile and non-volatile), bus lines (address, control, and data), and other hardware and software needed to perform the task of engine control. In the present invention, a signal proportional to spark plug energy dissipation may be obtained. The spark plug breakdown voltage 52 is also captured. The data may then be recorded to gain statistical records of the ignition process and stored via a data acquisition system. The data can also be fed back into the ECU 12. It is understood, however, that a similar measurement can be applied to a plurality of engine spark plugs as required with a possibility of sharing similar signals.

Referring to FIG. 1 of the ignition energy and breakdown voltage circuit 10, an ECU 12 is provided that controls the operation of ignition driver 16. The ECU 12, by turning on ignition driver 16, allows for the building up of current in the primary coil of ignition coil 18 as displayed in FIG. 3. The voltage signal, applied to driver 16, is represented by the Dwell wave form of FIG. 3. An engine battery voltage is fed via line 14 to ignition coil 18. The ECU 12 is in communication with ignition driver 16. Line 14 and ignition driver 16 being in communication with opposite ends of the primary winding of ignition coil 18.

Figure 3:
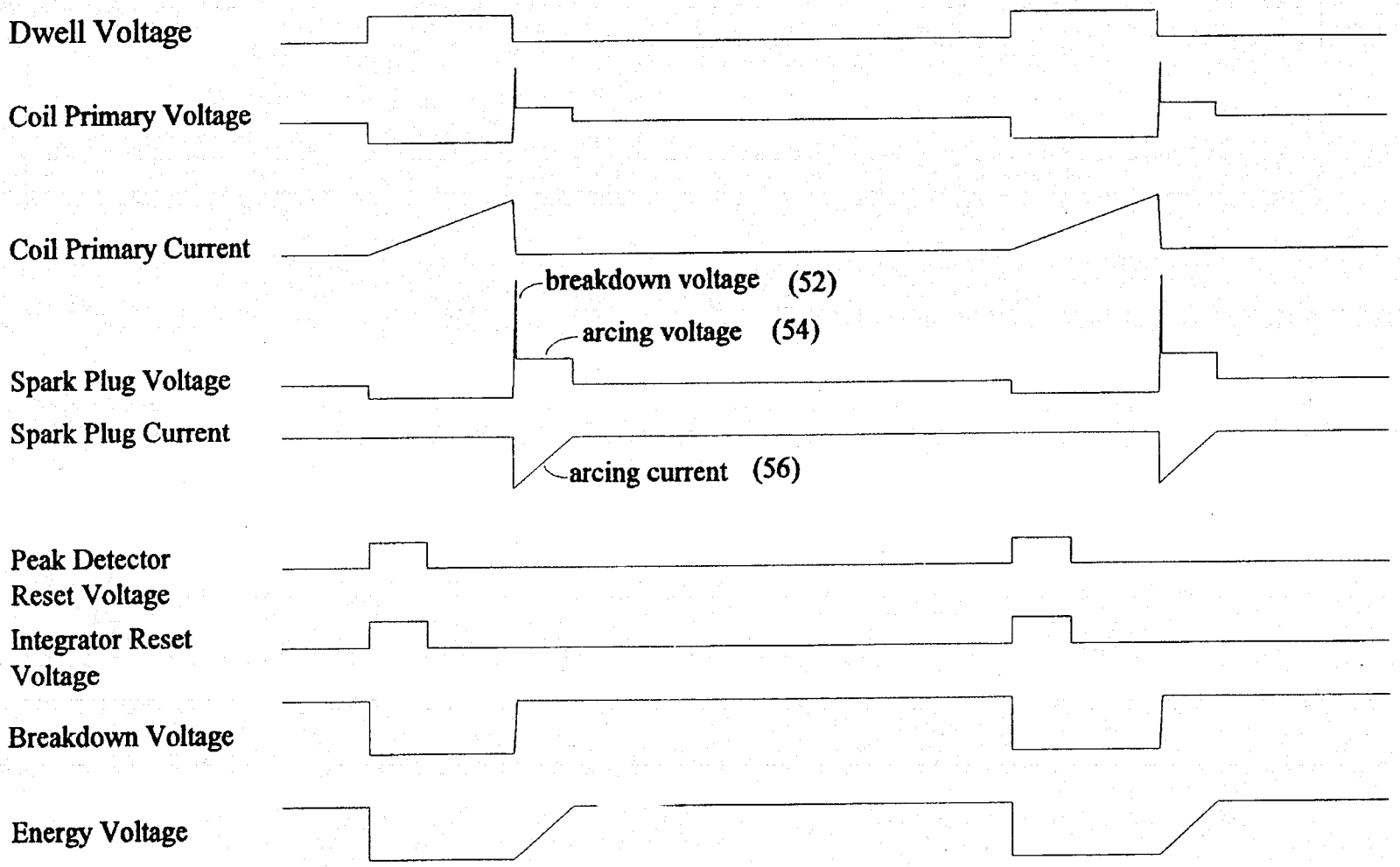
FIG. 3 is a signal representation of voltage and current output characteristics of various components of the present invention.

When the ignition driver 16 is turned off by ECU 12, a voltage spike occurs at the primary winding, as shown in FIG. 3, and the magnetic field of the ignition coil 18 starts to collapse. This generates a high voltage on the secondary winding, which in turn is transferred from the secondary winding to the spark plug 20. Voltage across the terminals of spark plug 20 builds up until it breaks down the resistance between the electrodes of spark plug 20. The fuel air mixture inside the cylinder is then ignited. The voltage spike settles and results in an arcing voltage 54 being produced across the terminals of spark plug 20 as shown in wave form representation of FIG. 3.

As shown in FIG. 3, the breakdown voltage signal 52 of spark plug 20 represented at node E is also transferred to a high state. The spark plug energy also begins to increase and is represented in scaled proportion at node D. The spark plug energy signal generated at node D is represented in volts and can then be scaled to equal an amount of Joules per Volt. In the presented embodiment a sense resistor 24 is employed to sense the arcing current 56 of spark plug 20. It is appreciated, however, that other electrical configurations could also be used, for sensing current, that are known in the art such as current probes, or current transformers.

The spark plug 20 is connected to an end of the secondary winding of ignition coil 18 while the opposite end is in communication with two resistors 22, 24. A first junction of resistors 22, 24 connected to an end of the secondary winding and a second junction connected to node A of a coaxial cable that is in turn connected to node B of the coaxial cable. Termination resistor 28 is in communication with node B and a current scaling amplifier 30 at a first end, and ground at a second end. A spark plug arcing current signal 56 is fed to the current scaling amplifier 30 which in turn sends the arcing current values to multiplier 34. The multiplier 34 is in communication with the current scaling amplifier 30.

Means for probing the breakdown voltage signal 52 of spark plug 20 are also provided. In the current embodiment, a high voltage probe 26 of the type TEKTRONIC P6015A is employed. It is to be expressly understood that other breakdown voltage probing devices could also be used having similar voltage tolerances and output characteristics. The high voltage probe 26 is in communication between the spark plug 20 and node C. Node C is fed into a voltage scaling amplifier 32. The voltage scaling amplifier 32 provides proper load impedance to assure good DC signal scaling. The amplifier 32 also provides the required AC transfer characteristics and receives an arcing voltage signal 54 of spark plug 20.

The voltage scaling amplifier 32, in communication with multiplier 34 and peak detector 36, sends out two signals. The first is to a multiplier 34 and the second to a means for storing the breakdown voltage signal 52 of the spark plug 20 represented by a peak detector 36. It is appreciated that any circuit means could be employed for storing the spark plug breakdown voltage signal 52, however, the present invention implements an analog peak detector 36 that is in communication with amplifier 32 and node E. The peak detector 36 holds the highest value of the scaled spark plug voltage which is the breakdown voltage. The peak detector 36 holds or stores this voltage value until a reset signal resets the ignition energy and breakdown voltage circuit 10 via reset circuit 40.

The reset circuit 40 is in communication with ECU 12 at its inputs 42, 44 and also in communication with peak detector 36 and integrator 38. Alternatively, the inputs 42,44 of reset circuit 40 can be connected to the primary winding of ignition coil 18 at terminals 14 and 16. The multiplier 34 multiplies the spark plug arcing current signal 56 by the arcing voltage signal 54 producing a power signal. The power signal corresponding to instantaneous power generated at the spark plug 20 and derived from the equation at time (t) of power P(t) equaling voltage V(t) times current I(t) and shown by $P(t)=V(t)*I(t)$.

The power signal is then fed into a means for integrating the power signal that represents an amount of energy delivered to the spark plug 20. In the present invention, the integrated signal means is represented by analog integrator 38 that is governed by the equation $\int P(t)dt$ integrated over the period (0) to (t). While it is understood that other circuitry could also be employed which performs the like function of an integrator. It is further appreciated that various types of integrators can be employed such as an operation amplifier, capacitor, or digital based integrators. The integrator 38 is in communication with the multiplier 34, reset circuit 40, and node D. The scaled spark plug energy signal generated at node D is defined by the equation $E=\int P(t)dt$ integrated over the period from 0 to time t. Whereby P(t) represents the power signal generated by the multiplier 34.

Figure 2:
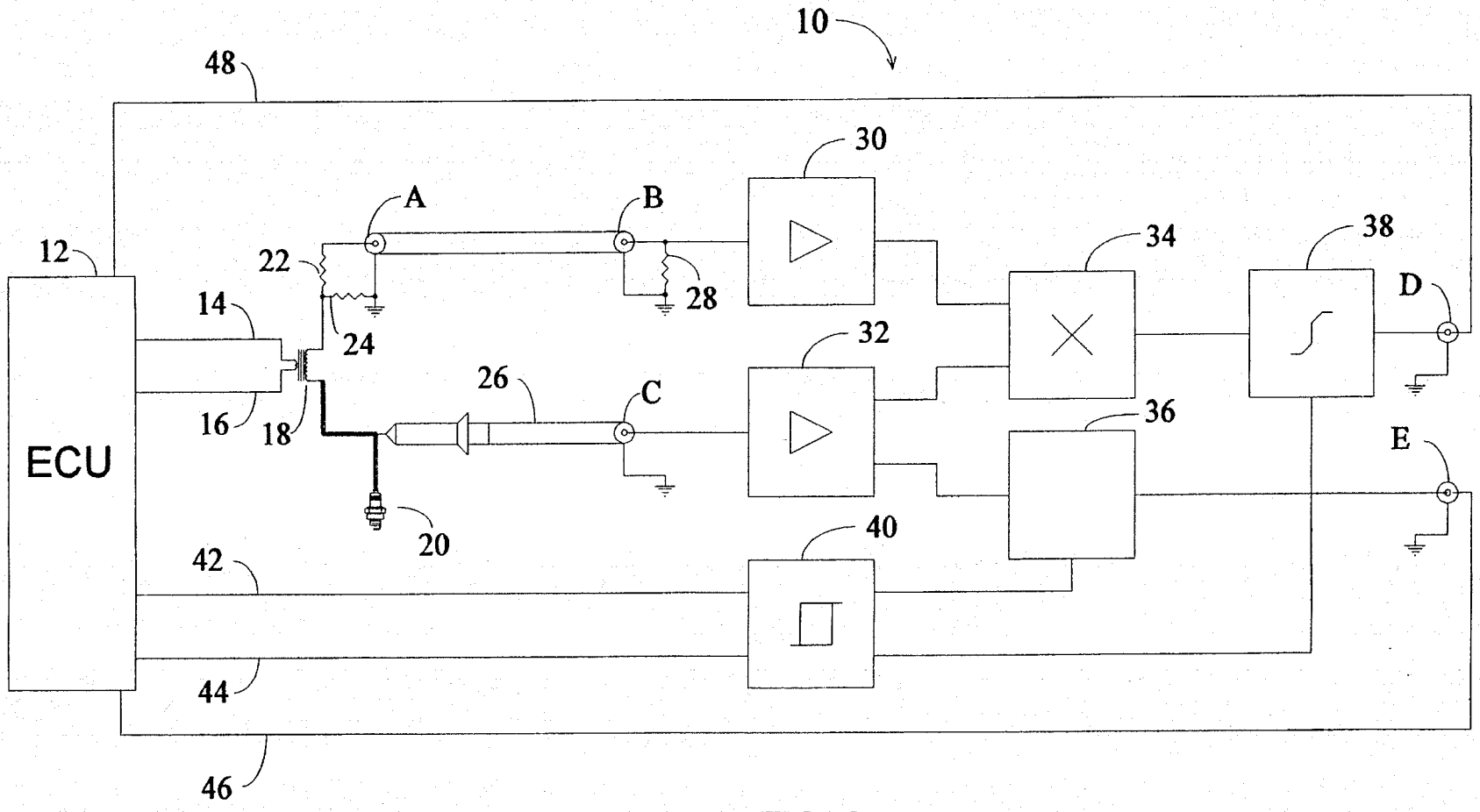
FIG. 2 is a block schematic diagram of the ignition energy and breakdown voltage circuit of the present invention with adaptive feedback.

Referring now to FIG. 2, an ignition energy and breakdown voltage circuit is shown having adaptive feedback. The circuit performs in the same manner as described and shown in FIG. 1 with corresponding operation shown in FIG. 3. The energy of spark plug 18, however, can also be adjusted in the embodiment shown in FIG. 2. In the circuit node D is fed back to ECU 12, via line 48, so that the ECU 12 can monitor the energy of spark plug 20. Likewise, node E is fed back to ECU 12, via line 46, so that the ECU 12 can monitor the spark plug breakdown voltage. It is understood that the present circuit can work equally well by merely generating spark plug energy and breakdown voltage at nodes D and E respectively for use in other circuits or service technician devices.

Figure 4:
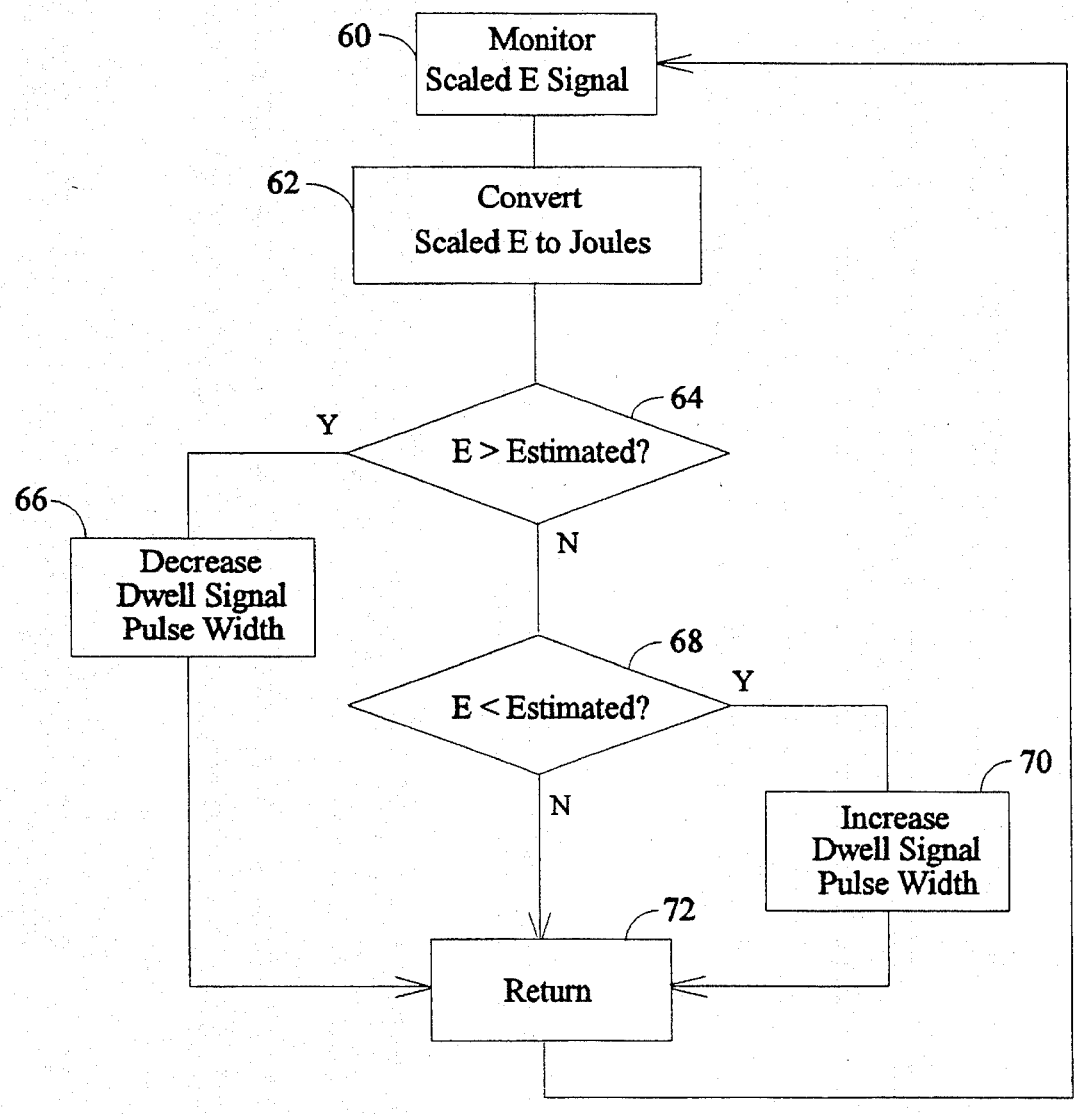
FIG. 4 is a flow chart diagram of the spark plug energy monitoring method of the present invention.

Referring now to FIG. 4, an adaptive method for changing spark plug energy according to the energy reading monitored at node D is provided. Beginning block 60, the method first monitors or reads a scaled energy signal monitored by ECU 12 and generated by the integrator 38 at node D. The method then falls to block 62 where the scaled energy reading obtained in block 60 is converted to Joules and stored in memory of ECU 12. The method then falls to decision block 64 where it is determined whether the actual spark plug energy reading is greater than an estimated or ideal energy reading. The ideal energy reading, taken from a calibration data specific look-up table, is stored in memory of ECU 12. The data can be calibrated by using any combination of engine parameters affecting spark so that desired operating conditions are met for a particular vehicle. Such engine parameters can consist of, but are not limited to, engine coolant temperature, throttle position, and manifold absolute pressure. If the answer in decision block 64 is yes, the method continues to block 66.

In block 66 of the present method, the Dwell signal pulse width is decreased. This has the effect of decreasing the primary peak current produced at ignition coil 18 and thereby decreasing the energy of spark plug 20. The method then returns to perform other tasks of engine control at block 72. If the answer in decision block 64 is no, the method falls to decision block 68 where it is determined if the actual energy reading is less than the estimated or ideal energy reading. If the answer in block 68 is no, the method falls to block 72 whereby the method returns to perform other tasks of engine control. Alternatively, if the answer in block 68 is yes, the method continues to block 70 whereby the Dwell signal pulse width is increased. This has the effect of increasing the primary peak current produced at ignition coil 18 and thereby increasing the energy of spark plug 20. The method then returns to perform other tasks of engine control at block 72.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above description is to be considered exemplary, rather than limiting, and the true scope of the invention is that defined in the following claims.

What is claimed is:

1. In an engine and associated ignition control method, the engine having at least one spark plug with an associated energy signal and ignition coil including a primary and secondary winding, the secondary winding connected to the associated at least one spark plug, and an Electronic Control Unit (ECU) with corresponding memory, the ECU connected to the primary winding of the ignition coil the ignition control method comprising the steps of:

monitoring the energy signal of the spark plug that is obtained by integrating a power signal generated by the spark plug over time;

scaling the energy signal of the spark plug to obtain a scaled energy value;

comparing the scaled energy value of the spark plug to an ideal energy value of the spark plug that is stored in the memory of the ECU;

decreasing a Dwell voltage signal pulse width of the primary winding of the ignition coil if the scaled energy value is greater than the ideal spark plug energy value, thereby decreasing the energy signal of the spark plug; and increasing the Dwell voltage signal pulse width of the primary winding of the ignition coil if the scaled energy value is less than the ideal spark plug energy value, thereby increasing the energy signal of the spark plug.

2. In an engine and associated ignition energy and breakdown voltage circuit, the engine having at least one spark plug and associated ignition coil including a primary and secondary winding, the secondary winding connected to the associated at least one spark plug and having a first and second end, the ignition energy and breakdown voltage circuit comprising:

a resistor connected to the first end of the ignition coil's secondary winding for sensing an arcing current generated by the at least one spark plug;

a high voltage probe, having a first end and a second end, the high voltage probe first end connected to the at least one spark plug for probing a breakdown voltage of the at least one spark plug;

a current scaling amplifier having an input and output, the current scaling amplifier's input in communication with the current sensing resistor for scaling the at least one spark plug arcing current;

a voltage scaling amplifier having an input and output, the voltage scaling amplifier's input connected to the high voltage probe's second end for scaling the at least one spark plug breakdown voltage;

a multiplier having an input and output, the multiplier input connected to the current scaling amplifier output and the voltage scaling amplifier output, for producing an arcing power signal by multiplying the at least one spark plug arcing current and an at least one spark plug arcing voltage;

a peak detector having an input and output, the peak detector input connected to the voltage scaling amplifier output, for storing the at least one spark plug breakdown voltage;

an integrator having an input and an output, the integrator input connected to the multiplier output, for producing an energy signal proportional to an amount of energy delivered to at least one spark plug by integrating the multiplier produced arcing power signal over time;

an Electronic Control Unit (ECU) with corresponding memory and at least one bus line, the ECU connected to the ignition coil's primary winding for sending a charging signal to the ignition coil; and means for resetting the ignition probing circuit having an input and output, the reset means input connected to the ECU and the reset means output connected to the peak detector and integrator.

3. In an engine and associated ignition energy and breakdown voltage circuit, the engine having at least one spark plug and an associated ignition coil having a primary and secondary winding, the secondary winding in communication with the at least one spark plug and having a first and second end, the ignition energy and breakdown voltage circuit comprising:

means for sensing an arcing current generated by the at least one spark plug, the sensing means in communication with the first end of the ignition coil's secondary winding;

a multiplier having an input and output, the multiplier's input in communication with the arcing current sensing means and the at least one spark plug, for producing an arcing power signal by multiplying the at least one spark plug arcing current and an at least one spark plug arcing voltage;

means for storing a breakdown voltage of the at least one spark plug, the breakdown voltage storage means having an input and output, the input in communication with the at least one spark plug; and means for integrating the multiplier produced arcing power signal over time, thereby producing an energy signal proportional to an amount of energy delivered to the at least one spark plug, the integration means having an input connected to the multiplier output.

4. The ignition energy and breakdown voltage circuit of claim 3 wherein the at least one spark plug arcing current sensing means comprises at least one resistor.

5. The ignition energy and breakdown voltage circuit of claim 4 wherein the breakdown voltage storing means comprises a peak detector.

6. The ignition energy and breakdown voltage circuit of claim 5 wherein the multiplier power signal integration means comprises an integrator.

7. In an engine and associated ignition energy and breakdown voltage circuit, the engine having at least one spark plug and an associated ignition coil having a primary and secondary winding, the secondary winding in communication with the at least one spark plug and having a first and second end, the ignition energy and breakdown voltage circuit comprising:

means for sensing an arcing current generated by the at least one spark plug, the sensing means in communication with the first end of the ignition coil's secondary winding;

means for probing an at least one spark plug breakdown voltage, having a first end and a second end, the at least one spark plug breakdown voltage probing means first end in communication with the at least one spark plug;

a multiplier having an input and output, the multiplier's input connected to the arcing current sensing means and the at least one spark plug breakdown voltage probing means second end, for producing an arcing power signal by multiplying the ignition coil arcing current and an arcing voltage of the at least one spark plug;

a peak detector having an input and output, the peak detector input connected to the at least one spark plug breakdown voltage probing means second end, for storing the at least one spark plug breakdown voltage;

an integrator having an input and output, the integrator input connected to the multiplier output, for integrating the multiplier produced arcing power signal over time, thereby producing an energy signal proportional to an amount of energy delivered to the at least one spark plug; and means for resetting the ignition probing circuit having an input and output, the reset means input connected to the ECU and the reset means output connected to the peak detector and integrator.

8. The ignition energy and breakdown voltage circuit of claim 7 wherein the current sensing means comprises at least one resistor.

9. The ignition probing circuit of claim 8 wherein the at least one spark plug breakdown voltage probing means comprises a high voltage probe.

* * * * *